US007216377B2

(12) United States Patent
Nocera et al.

(10) Patent No.: US 7,216,377 B2
(45) Date of Patent: May 15, 2007

(54) SIPHON FOR SINK OR SIMILAR ELEMENT

(76) Inventors: Carmelo Nocera, 93, rue Roger Salengro, F-62290 Noeux les Mines (FR); Vito Cecconi, 38, rue Rene Lannoy, F-62300 Lens (FR)

( * ) Notice: Subject to any disclaimer, the term of this patent is extended or adjusted under 35 U.S.C. 154(b) by 0 days.

(21) Appl. No.: 10/518,984

(22) PCT Filed: Jun. 23, 2003

(86) PCT No.: PCT/FR03/01927

§ 371 (c)(1),
(2), (4) Date: Jun. 23, 2005

(87) PCT Pub. No.: WO04/001144

PCT Pub. Date: Dec. 31, 2003

(65) Prior Publication Data

US 2005/0229305 A1 Oct. 20, 2005

(30) Foreign Application Priority Data

Jun. 24, 2002 (FR) ..... 02 07791

(51) Int. Cl.
*E03C 1/28* (2006.01)

(52) U.S. Cl. ..... 4/679; 4/256.1; 137/247.37

(58) Field of Classification Search ..... 4/256.1, 4/679; 137/247.37, 247.39, 247.51
See application file for complete search history.

(56) References Cited

U.S. PATENT DOCUMENTS

| | | | | |
|---|---|---|---|---|
| 1,613,908 | A * | 1/1927 | Sandman | 137/247.37 |
| 2,593,734 | A * | 4/1952 | Davis | 4/679 X |
| 5,058,214 | A * | 10/1991 | Shinn | 4/679 |
| 5,255,402 | A | 10/1993 | Kashani | |
| 5,715,550 | A | 2/1998 | Griffin | |

FOREIGN PATENT DOCUMENTS

| | | |
|---|---|---|
| BE | 379 581 A | 5/1931 |
| FR | 2 752 453 A | 2/1998 |

* cited by examiner

*Primary Examiner*—Robert M. Fetsuga
(74) *Attorney, Agent, or Firm*—Egbert Law Offices

(57) ABSTRACT

A siphon for a sink or similar element includes an upper part, a lower pivoting part, and a connection device disposed between the parts and a gasket. The connection device includes: at least one hinge which is used to pivot and guide the lower part around the axis of the hinge and which can be uncoupled such that the lower and upper parts can be completely separated; and a locking mechanism disposed between the lower and upper parts and which have at least one clip. The connection device can be used to align the lower part of the siphon and the upper part thereof and to compress the gasket when the two parts are connected.

3 Claims, 1 Drawing Sheet

SIPHON FOR SINK OR SIMILAR ELEMENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention concerns a water trap for a sink or similar.

BACKGROUND OF THE INVENTION

By sink is meant any type of receptacle or basin drilled with a hole for the evacuation of waters, said hole being linked to a duct, itself connected to a water trap.

The water traps are devices arranged on evacuation ducts and serve mainly for preventing any communication between the soiled air and the surrounding air. Still, said water traps also prove convenient for collecting objects inserted through the evacuation hole of the waters or possibly for cleaning the duct connecting the sink to said water trap.

To this end, said water trap comprises an upper portion and a lower portion, the latter being notably intended to act as a reservoir for the objects inserted through said evacuation hole.

In order to access said lower portion, devices are known which enable to screw between themselves said lower and upper portions which include a taper or a thread.

These devices exhibit however various shortcomings among which one may note the obligation for the user to use tools specific to dismantling which may imply in practice for the user to resort to the services of a plumber.

This type of link between the upper and lower portions also exhibits a tightness defect, indeed, the pressure exerted on the seal depends in these screw-type devices on the number of screw turns performed by the user. Thus, if the user screws the lower portion excessively on the upper portion, there may result therefrom irreversible deformation of the seal due to an excessive pressure exerted. In the reverse case, if the user does not screw said lower pressure enough, there may result leakage problems, whereas said sealing joint may not fulfil its part since it is not pressed sufficiently against the walls of both upper and lower portions.

Moreover, in a case when the walls of the upper and lower portions contact the seal are not smooth, said seal matches locally the deformations of said walls. Still, in a case of unscrewing, then re-screwing, the local deformations of the seal are not arranged at the local deformations of the walls, which brings there again tightness defects.

The purpose of the present invention is to offer a water trap for a sink or similar which remedies the shortcomings aforementioned and enables manual disconnection of the upper and lower portions of the water trap without having to resort to tools.

It is another object of the present invention is to offer a water trap or similar which enables to disconnect partially or totally said upper portion from said lower portion.

It is another object of the present invention is to offer a water trap for a sink or similar which comprises means for centering lower and upper portions between themselves in order to facilitate the connection thereof.

It is another object of the present invention is to offer a water trap for sink or similar wherein said sealing joint undergoes controlled and reproducible compression at each closing of the water trap for total tightness of said water trap.

Other objects and advantages of the present invention will appear in the following description which is given for exemplification purposes only, without being limited thereto.

BRIEF SUMMARY OF THE INVENTION

Said invention concerns a water trap for a sink or similar including an upper portion and a pivoting lower portion, linking means between said lower and upper portions and a sealing joint. According to the invention, said linking means comprise:

- at least on a hinge enabling said lower portion to pivot round the axis of said hinge, and
- locking means between said lower and upper portions, said linking means enabling to center said lower portion with said upper portion of tho water trap and to compress the searing joint when both portions are linked.

The invention also relates to a waste water evacuation device fitted with a water trap as aforementioned.

BRIEF DESCRIPTION OF THE SEVERAL VIEWS OF THE DRAWINGS

It will be understood better when reading the following description, accompanied by the appended drawings which are part thereof.

DETAILED DESCRIPTION OF THE INVENTION

The present invention relates to a water trap 1 for a sink or similar. It is for example a water trap intended to fit waste water evacuation ducts, it will be particularly suited in professional or private premises, in kitchens or in bathrooms.

Figure 1:
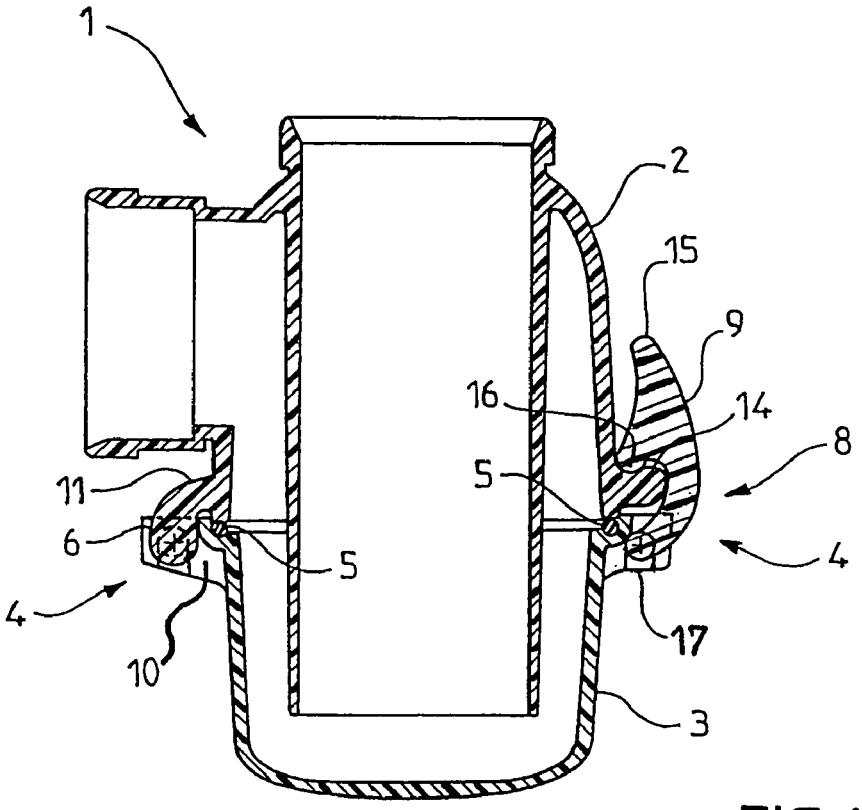
FIG. 1 illustrates a sectional view of an embodiment of the water trap according to the invention.
Figure 2:
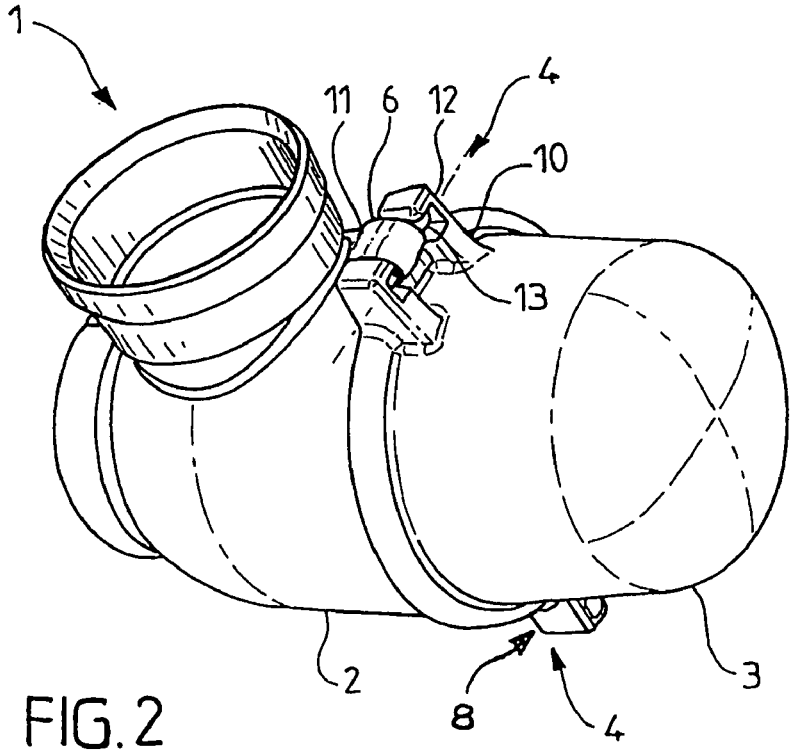
FIG. 2 illustrates a perspective view of the embodiment represented on previous FIG. 1.

As represented on FIGS. 1 and 2, said water trap 1 for a sink or similar includes an upper portion 2 and a pivoting lower portion 3. Said lower portion 3 is notably intended to form an Accessible reservoir enabling a user to clean said water trap 1 as well as the ducts to which the latter is connected to possibly to collect objects stored in said reservoir.

To render said reservoir accessible, said water trap 1 includes linking means 4 between said lower 3 and upper 2 portions.

With reference more particularly to FIG. 1, there is provided a sealing joint 5, notably in a circular groove, between said lower 3 and upper 2 walls in order to preclude any leakage.

The linking means 4 include at least one hinge 6 enabling said lower portion 3 to pivot and to be guided around the axis of said hinge 6. This hinge includes two elements 10 and 11, protruding outwardly from the water trap, slaved respectively to said lower wall 3 and to said upper wall 2 and enabling the guiding thereof when pivoting.

Said elements 10 and 11 are assembled so that one of them may pivot inside the other, and define the axis of the hinge 6.

While referring to FIG. 2, it can also be seen that said element 10 is in the form of a sink or cap piece, and includes two lateral internal ribs 12, notably open, possibly exhibiting a slight restriction at the opening thereof which, with a padding restricting the opening, enables insertion, notably forcibly, of toes 13 of said element 11, forming a pivot.

Said ribs 12 and toes 13 co-operate together so that said toes pivot in said rib, the latter forming a cradle for each toe.

It is also possible to withdraw said toes 13 from said ribs 12 in order to dismantle said hinge 6 while separating said elements 10 and 11. This advantageous embodiment wherein the hinge 6 can be dismantled enables to separate totally said lower portion 3 from said upper portion 2 in order for example to clean it in a tub.

Still, in other embodiments, it would not be necessary to dismantle said hinge 6 composed of the elements 10 and 11.

Said linking means 4 include moreover locking means 8 between the lower 3 and upper 2 portions. While reporting to FIG. 1, it can be seen that said locking means 8 are formed of a clip 9.

This clip 9 includes three elements, a base 17, in the form of a yoke or cap piece, protruding outwardly from the water trap, slaved to one of the lower 3 and upper 2 portions, and preferably the lower portion 3, a stud 14, protruding outwardly from the water trap, slaved to the other portion, preferably the upper portion 2, and a locking element 15, globally in the form a reverted C, as a hollow part matching said stud, mounted to pivot with said co-operating by means of a stop 16 with said stud 14.

According to the embodiment of FIG. 1, the elements are snapped together forcibly. To this end, the user makes said locking element 15 pivot until the stop 16 contacts said stud 14. The user then applies a pressure in order to deform slightly said locking element 15 which enables to lock said stop 16 on said stud 14. At that level, the lower portion 3 of the water trap 1 is locked on the upper portion 2.

It is important to observe that, in case of forcible snap-type assembly, a clip 9 made of plastic material may be used preferably, which will press, thanks to its structure, the stop 16 against said stud 14.

Similarly, said hinge 6 and even more generally said water trap 1 may be designed entirely of plastic, which exhibits advantageously a material easily washable and resistant to chemical attacks of the components of waste water, and with interesting elastic properties.

As with said hinge 6, it is also possible to contemplate that said locking element 15 may be separate from its base 17. To this end, one may also use an assembly system between said element 15 principle as that described for said hinge 6, using once again toes, forming a pivot, co-operating in ribs, forming cradles, drilled in said base 17.

When the user wishes to access the reservoir, he causes said locking element 15 to pivot, thereby separating said lower portion 3 from said upper portion 2 and then causes said lower portion 3 to pivot around the axis of the hinge 6. Said upper 2 and lower 3 parties may therefore be unlocked and separated manually without using any tools.

Conversely, when the user wishes to close said water trap 1, he causes said lower portion 3 to pivot around the axis of the hinge 6. When said lower portion 3 abuts against said upper portion 2, the axes of both portions coincide, thanks to the structure, described above, of said hinge 6 which enables guiding and consequently automatic centering of both portions relative to one another.

The user causes said portion 3 to pivot further as described previously, which enables to compress said sealing joint 5. Taking into account that the pressure exerted by means of said clip 9 is always the same, the compression of the sealing joint is constant. Moreover, since the lower and upper portions are aligned relative to one another always in the same way, the compression is also homogeneous.

One may also note that to retain said sealing joint 5 better, the rims of the lower 3 and upper 2 portions may be imbedded, forming said circular groove. This characteristic also enables to improve centering of said lower 3 and upper 2 portions relative to one another, as well as the sealing thereof.

While referring to either of FIGS. 1 and 2, it can be seen that in the embodiment, the water trap 1 includes a clip 9 and a hinge 6. Still, in other embodiments, and relative notably to the shape of said lower portion 3, one may use a different number of clips 9 and of hinges 6, and notably if one uses a lower portion 3 whereof the bottom is substantially quadrangular, it will be possible to use two hinges 6 arranged on one side and two clips 9 arranged on the opposite side.

It is also reminded that the invention concerns moreover a waste water evacuation device fitted with a water trap 1 as aforementioned.

Naturally, other embodiments, obvious to the man of the art, could have been contemplated without departing from the framework of the invention defined by the claims below.

We claim:

1. A water trap for a sink comprising:

an upper portion;

a lower portion pivotally connected to said upper portion;

a linking means positioned between said upper portion and said lower portion, said linking means for centering said upper portion with respect to said lower portion;

a sealing joint in sealing relation to said upper and lower portion, said linking means comprising:

at least one hinge connected to said lower portion so as to allow said lower portion to pivot around an axis of the hinge, the hinge being dismantleable so as to separate said lower portion from said upper portion; and a locking means mounted to said upper portion and said lower portion for locking said upper portion to said lower portion, said locking means formed of a clip, said locking means for compressing said sealing joint when said upper portion is engaged with said lower portion, said upper portion and said lower portion being forced together by snapping said locking means, said locking means comprising:

a base connected to one of said upper and lower portions; and a stud extending outwardly of the other of said upper and lower portion, said clip having a locking element having a curved edge and stop abutment, said clip being pivotally mounted to said base such that said curved edge of said locking element engages said stud, locking element being in snapping engagement with said stud at said stop abutment.

2. The water trap of claim 1, said clip and said hinge being formed of a polymeric material.

3. The water trap of claim 1, said upper portion having a rim at a bottom thereof, said lower portion having a rim at a top thereof, one of the rims being engaged within the other of the rims so as to center said upper portion with respect to said lower portion.

* * * * *